United States Patent [19]

Wirth

[11] 4,010,713

[45] Mar. 8, 1977

[54] ELECTROSTATIC POWDER SPRAY COATING APPARATUS

[75] Inventor: Hermann Wirth, Gundelfingen, Germany

[73] Assignee: Robert Bosch G.m.b.H., Stuttgart, Germany

[22] Filed: Mar. 28, 1975

[21] Appl. No.: 563,075

[30] Foreign Application Priority Data

Mar. 29, 1974 Germany ..... 2415296

[52] U.S. Cl. ..... 118/621; 118/323; 239/223

[51] Int. Cl.² ..... B05C 5/02

[58] Field of Search ..... 118/626, 627, 629; 239/223, 224, 15, 323

[56] References Cited

UNITED STATES PATENTS

| | | | |
|---|---|---|---|
| 1,636,949 | 7/1927 | Bassler | 239/224 |
| 1,753,019 | 4/1930 | Page | 239/224 |
| 2,220,275 | 11/1940 | Preston | 239/223 |
| 2,975,757 | 3/1961 | Reindl | 118/627 |
| 2,976,175 | 3/1961 | Reindl | 118/627 |
| 3,082,956 | 3/1963 | Point | 239/223 |
| 3,148,832 | 9/1964 | Point | 118/626 X |
| 3,181,502 | 5/1965 | Reindl et al. | 118/627 |
| 3,307,789 | 3/1967 | Clark | 118/626 UX |

FOREIGN PATENTS OR APPLICATIONS

| | | | |
|---|---|---|---|
| 38-16073 | 12/1963 | Japan | 118/626 |

*Primary Examiner*—Ronald Feldbaum
*Attorney, Agent, or Firm*—William R. Woodward

[57] ABSTRACT

The rotary disk that mechanically provides radial acceleration to the particles of the coating powder as they enter the electrostatic field of the apparatus is provided with a grid or screen of fine wires on its upper side near its outer edge to break up agglomerates of the coating material that may be present in the powder when it reaches the neighborhood of the disk.

4 Claims, 2 Drawing Figures

ELECTROSTATIC POWDER SPRAY COATING APPARATUS

Figure 1:
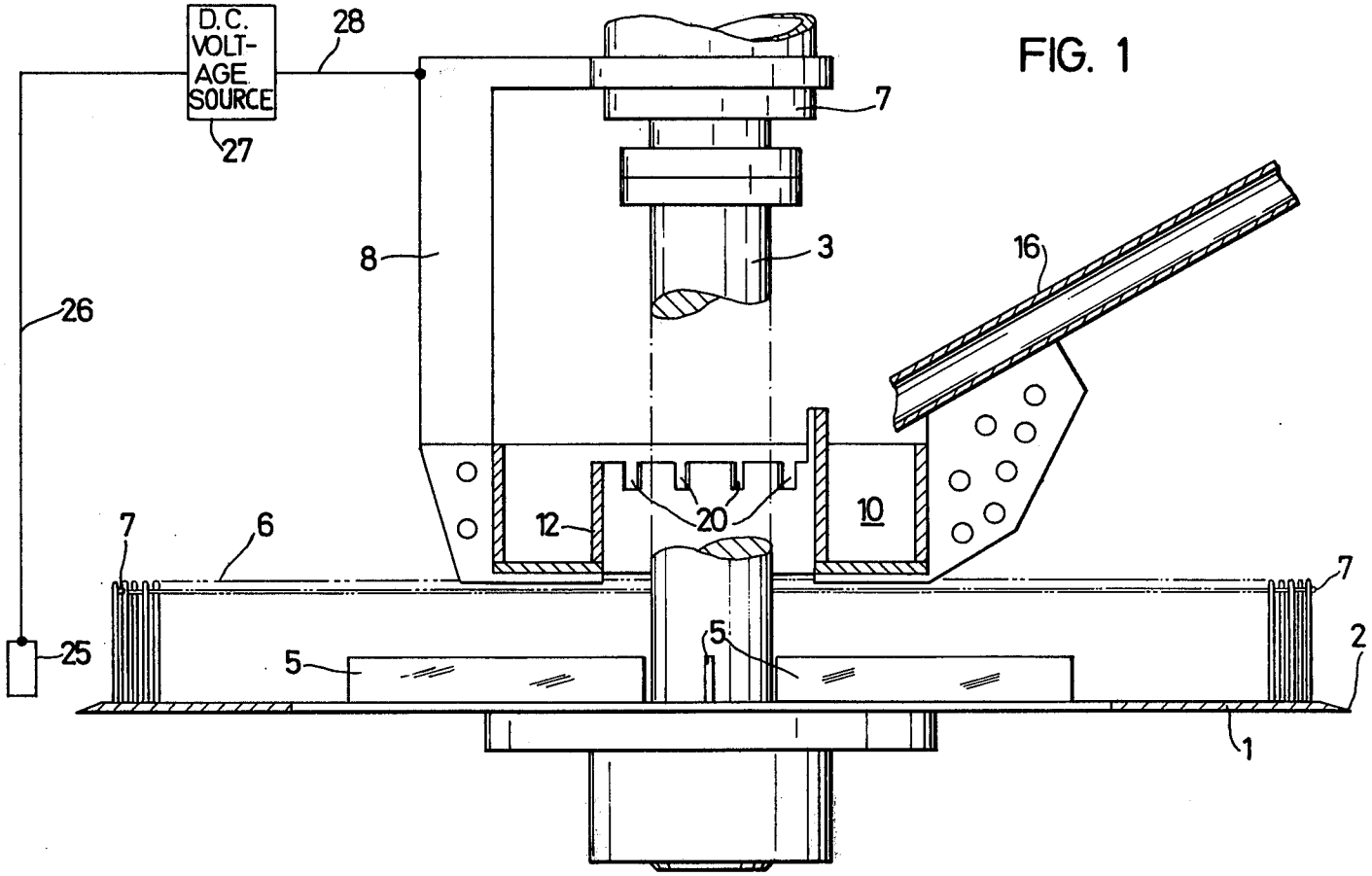

This invention relates to electrostatic powder coating apparatus and particularly a type in which a rotating disk is used to propel the coating powder particles into an electrostatic field that then carries the powder particles onto the articles to be coated. The powder is fed on the spray disk near its center and the disk and the air current engendered by its motion impart a radial acceleration to the powder particles.

In such apparatus, largely on account of the susceptibility of the powder particles to a chemical transformation reaction (the coating material is commonly a thermosetting resin which it is desired to harden in place after the coating operation has been completed), there is a tendency of the powder particles to form agglomerates during their passage through the apparatus, that is, before they arrive on the article to be coated and the formation of these agglomerates not only disturbs the operation of the coating apparatus, but impairs the quality of the coating. Extensive precautions are required to prevent or reduce the formation of these agglomerates, as for example set forth in my co-pending application Ser. No. 563,076, filed Mar. 28, 1975, now U.S. Pat. No. 3,942,721. There is a particular type of agglomeration of the coating powder which most of the precautions against agglomeration fail to counteact, including those described in my aforesaid co-pending application, since this particular type of agglomeration can take place in the immediate neighborhood of the rotating spray disk. This type of agglomeration is one in which the powder particles are united into relatively loose agglomerates as the result of electrical charges. These agglomerates also diminish the quality of the completed agglomerates if they are present in the powder as it reaches the coating if they are present in the powder as it reaches the surface of the articles being coated.

It is accordingly an object of the present invention to provide an electrostatic powder coating apparatus of a type that renders harmless any agglomerates of the type last mentioned that may be formed in the process of transporting the coating powder towards the articles to be coated.

SUBJECT MATTER OF THE PRESENT INVENTION

Briefly, on the upper side of the rotatable disk that distributes and sprays the powder, between the region in which the powder is fed onto the disk and the edge of the disk, a plurality of impact-generating partial obstructions are provided in a suitable regular array, these impact elements serving to break up the larger agglomerates of the coating material by impact.

The impact elements are preferably so arranged that the spacing between adjacent impact elements subtends a very small angle at the disk center. The impart elements are preferably individual narrow bodies, such as rods or wires and a particularly advantageous form of the invention is provided when these elements together form a cylindrical grid coaxial with the spray disk. Such a grid can be advantageously located at the very edge of the spray disk. In such a grid a mesh width (opening dimension) of 1 to 1.5 mm and a wire diameter from 0.3 to 0.5 mm are particularly suitable.

The manner of operation of the apparatus in accordance with the invention can be improved if the spray disk is equipped with perpendicularly upstanding radial vanes on its upper side extending outward from the middle of the disk.

Figure 2:
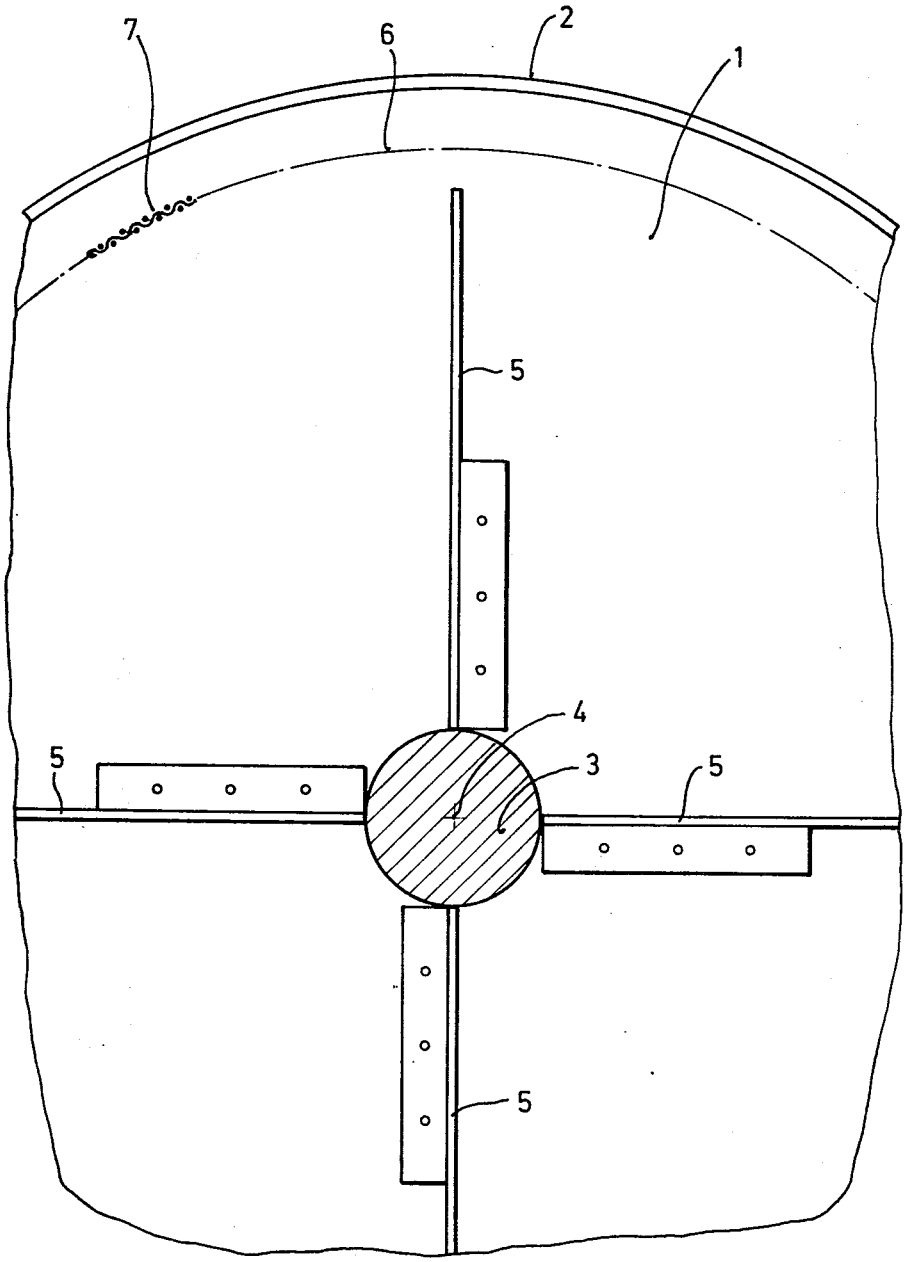

The invention is further described by way of example with reference to the accompanying drawings, in which:

FIG. 1 is a diagrammatic elevation view of the principal parts of an electrostatic powder coating apparatus embodying the invention, and FIG. 2 is a partial top view of the rotary spray disk of the apparatus of FIG. 1.

FIG. 1 shows, partly in section, the portion of an electrostatic powder spray coating apparatus which includes the rotary spray disk 1 and its associated equipment. The rotary disk 1 is mounted on a shaft 3 which is provided with bearings and a drive (not shown) within a housing of which a portion is shown at 7. An annular trough 10 hangs from a bracket 8 on the housing 7 and is supplied with coating powder through a feed tube 16 from a supply container that is not shown in the drawing. The coating powder overflows the trough 10 through the bottoms of the slots 20 in the inner wall 12 of the trough and falls onto the central portion of the rotating disk 1. The rotation of the disk imparts a radial acceleration to the powder particles that then stream outward away from the shaft 3 and the air currents produced by the vertical vanes 5 likewise impart a whirling movement and thereby a radial velocity to the powder particles in the neighborhood of the upper surface of the disk 1.

The articles to be coated are located around the periphery of the disk and may be mounted on holders that turn them to assure even coating. The articles and their mountings are not shown in FIG. 1 except for the diagrammatic representation of a single article designated 25 provided with a connection 26 to a voltage source 27, the other terminal of which is connected to the frame of the apparatus by the connection 28, this indicating generally the application of an electric field to produce the desired type of coating layer.

On the upper side of the disk 1, in the neighborhood of the edge 2 thereof, there is provided an array of upstanding narrow rods or stiff wires forming cylindrical grid 6 coaxial with the disk 1. One or more horizontal wires such as the wire 7 may be woven through the cylindrical grid 6 for stiffening purposes or for increasing the collision cross section of the grid. The outer portion of the disk 1 is shown in crosss section and the front half of the cylindrical grid 6 is entirely omitted, while all but the left and right ends of it are indicated only by dashed line outlines in FIG. 1 in order to simplify the illustration.

In FIG. 2 a portion of the disk 1 including the central portion and a part of the outer portion is shown in plan view and here again for simplification of the illustration only a portion of the vertical rods or wires of the grid 6 is shown and likewise only a part of the wire 7 is shown. The narrow bodies of the array 6, preferably in the form of thin rods or wires, are preferably regularly and closely spaced, with the clearance between adjacent parallel bodies of this sort preferably in the range from 1 to 1.5 mm, with the rod or wire diameters being in the range from 0.3 to 0.5 mm. Adjacent vertical rods or wires subtend a very small angle at the center 4 of the disk 1, so that only the original powder grains and negligibly small agglomerates have a high probability of passing through the cylindrical grid 6 without collision.

In operation the coating material in the form of a stream of powder falls onto the central part of the disk by flowing over the inner wall 12 of the trough 10 and the air currents formed by the rotation of the disk 1 pick up the powder thereby giving it a whirling and radial motion. The particles of powder are forced through the grid 6, the dimensions of which are designed to provide a very high probability that agglomerates of the loose type previously mentioned, that are formed by electrical charge effect, will hit the grid wires and, since they are relatively loose aggregations, will be broken up by the impact. Any agglomerates that are not broken up into particles small enough to pass through the grid cannot penetrate through the grid into the region of the electric field that propels the particles from the edge 2 of the disk towards the articles such as the article 25.

The above-mentioned dimension ranges for the grid 6 are, as is evident, the result of a compromise: too small a mesh width would excessively interfere with the air stream and hence with the transport of the coating powder and could also lead to a stopping up of the grid, whereas too great a mesh width would excessively reduce the probability that agglomerates formed by electric charge phenomena would hit the grid wires and thereby reduce the efficiency of the apparatus according to the invention to an undesirable degree. The dimension ranges above mentioned have been found to be usable with good results but are subject to some variation in particular cases depending on operating conditions, such as the condition of the coating material, the speed of operation of the disk 1, and the like. The cylindrical grid 6 may be located at the very edge of the disk, just inside an external bevel (as shown in FIG. 1), or at some spacing from the edge of the disk, as for example as shown in FIG. 2, or even somewhat further away from the edge that shown in FIG. 2.

I claim:

1. Electrostatic powder spray coating apparatus having a rotary spray-distributing disk, means for feeding coating powder to the central portion of said disk, means for applying an electric field between articles to be coated and, on the other hand said disk and said feed means, whereby particles of said coating powder are launched mechancially field under the influence of which the powder is applied to articles said to be coated, and means for breaking up agglomerates of the coating material in its path towards the articles to be coated in the form of a regularly spaced cylindrical grid of a plurality of elongated impact elements (6) located on the upper side of said rotary disk, at or near the periphery of the disk.

2. Electrostatic powder spray coating apparatus as defined in claim 1, in which said cylindrical grid is located immediately adjacent the edge (2) of said rotary disk (1).

3. Electrostatic powder spray coating apparatus having a rotary spray-distributing disk, means for feeding coating powder to the central portion of said disk, means for applying an electric field between articles to be coated and, on the other hand said disk and said feed means, whereby particles of said coating powder are launched mechanically into an electric field under the influence of which the powder is applied to said articles to be coated, and means for breaking up agglomerates of the coating material in its path towards the articles to be coated in the form of a regularly spaced cylindrical grid of plurality of elongated impact elements (6) located on the upper side of said rotary disk at or near the periphery of the disk, said cylindrical grid (6) having a mesh spacing in the range from 1 to 1.5 millimeters and an impact element thickness in the range from 0.3 to 0.5 millimeters.

4. Electrostatic powder spray coating apparatus having a rotary spray-distributing disk, perpendicularly upstanding radical vanes (5) extending outwardly from the middle of said rotary disk, means for feeding coating powder to the central portion of said disk, means for applying electric field between articles to be coated and, on the other hand said disk and said feed means, whereby particles of said powder are launched mechanically into an electric field under the influence of which the powder is applied to said articles to be coated, and means for breaking up agglomerates of the coating material in its path towards the articles to be coated in the form of a regularly spaced cylindrical grid of a plurality of elongated impact elements (6) located on the upper side of said rotary disk at or near the periphery of the disk, said impact elements being of a thickness and spacing suitable for breaking up said agglomerates by impact of said agglomerates thereon, said radial vanes (5) on said disk having ends at a radial distance substantially short of the cylinderical grid.

* * * * *

UNITED STATES PATENT AND TRADEMARK OFFICE

CERTIFICATE OF CORRECTION

PATENT NO. : 4,010,713

DATED : March 8, 1977

INVENTOR(S) : Hermann WIRTH

It is certified that error appears in the above-identified patent and that said Letters Patent are hereby corrected as shown below:

Claim 1, Col. 3, line 47, after "mechanically" the words "into an electric" are to be inserted.

Claim 1, Col. 3, line 48, the words "articles said" should be changed to -- said articles --.

Claim 4, Col. 4, line 30, the word "radical" should be changed to -- radial --.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*